US008252147B2

(12) United States Patent
Ohuchi

(10) Patent No.: US 8,252,147 B2
(45) Date of Patent: Aug. 28, 2012

(54) PRESS FELT FOR PAPERMAKING

(75) Inventor: Takashi Ohuchi, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 396 days.

(21) Appl. No.: 12/593,689

(22) PCT Filed: Dec. 27, 2007

(86) PCT No.: PCT/JP2007/075415

§ 371 (c)(1),
(2), (4) Date: Oct. 19, 2009

(87) PCT Pub. No.: WO2008/129750

PCT Pub. Date: Oct. 30, 2008

(65) Prior Publication Data

US 2010/0043998 A1 Feb. 25, 2010

(30) Foreign Application Priority Data

Mar. 30, 2007 (JP) ..... 2007-093190

(51) Int. Cl.
*D21F 7/08* (2006.01)
*B32B 5/02* (2006.01)
*B32B 5/06* (2006.01)

(52) U.S. Cl. ..... 162/358.2; 162/900; 442/271; 442/275

(58) Field of Classification Search ..... 162/358.1, 162/358.2, 900, 902, 903; 442/270, 271, 442/272, 274, 275
See application file for complete search history.

(56) References Cited

U.S. PATENT DOCUMENTS

| | | | | |
|---|---|---|---|---|
| 4,162,190 | A * | 7/1979 | Ashworth | 162/358.2 |
| 5,549,967 | A | 8/1996 | Gstrein | |
| 6,159,880 | A * | 12/2000 | Schiel | 442/270 |
| 6,207,276 | B1 | 3/2001 | Spindler et al. | |
| 6,998,023 | B2 | 2/2006 | Crook | |
| 7,267,745 | B2 * | 9/2007 | Crook, Jr. | 162/358.2 |
| 2004/0137819 | A1 | 7/2004 | Oda et al. | |
| 2008/0038975 | A1 | 2/2008 | Weiss et al. | |

FOREIGN PATENT DOCUMENTS

| | | | |
|---|---|---|---|
| DE | 198 03 493 | C1 | 4/1999 |
| JP | 51-105403 | | 9/1976 |
| JP | 8-302584 | A | 11/1996 |
| JP | 2000-170086 | A | 6/2000 |
| JP | 2004-143627 | A | 5/2004 |
| JP | 2007-327155 | A | 12/2007 |
| WO | 0233170 | A1 | 4/2002 |
| WO | 2005098128 | A1 | 10/2005 |

* cited by examiner

*Primary Examiner* — Eric Hug
(74) *Attorney, Agent, or Firm* — Howson & Howson LLP

(57) ABSTRACT

A press felt 10 comprises a base body 30 and a batt layer having a wet paper side layer 20. The wet paper web side layer 20 has a base body side batt layer 22, upright fiber bundles 50 are formed in the basebody side batt layer 22. After needle punching a core-in-sheath fiber 41, the upright fiber bundles are formed by melting the sheath member of the core-in-sheath fibers 41 into a pillar form melted by heat treatment. As a result, the base body side batt layer 22 is made dense and blocks water within the press side batt layer 23 from moving to the wet paper web side, thereby preventing rewetting; moreover, the invention successfully enhances resistance to abrasion and compression fatigue of the felt 10 by the upright fiber bundles 50 fusion-bonded into a pillar form.

12 Claims, 4 Drawing Sheets

PRESS FELT FOR PAPERMAKING

FIELD OF INVENTION

The present invention relates to a press felt for paper manufacture used in a paper manufacturing machine (hereinafter referred to merely as a "press felt").

BACKGROUND ART

Press machines have been used to squeeze water out of a wet paper web in a paper manufacturing process. In a press machine, a wet paper web formed with layers therein is dewatered within a press nip, sandwiched between a pair of press felts. Press machines generally have a plurality of press nips.

FIG. 4 is a schematic view of a press nip in a press machine. A pair of press rolls P', P' and a pair of press felts 11', 11' form a press nip. The press felts 11', 11' and a wet paper web W' are compressed within a pressure portion between the press rolls P', P', where water is removed from the wet paper web W' and absorbed by the press felts 11', 11'.

The volume of the wet paper web W' and the press felts 11', 11' rapidly expands when they travel through the middle of the press portion (the nip) to the exit thereof, as they are rapidly released from compression. This expansion generates negative pressure within the press felts 11', 11' which, coupled with the capillary phenomenon within the wet paper web W' associated with thin fibers therein, results in re-wetting, a phenomenon in which water absorbed by the press felts 11', 11' backs to the wet paper web.

Unexamined Japanese Patent Publication No. 143627/2004 discloses a press felt intended to prevent rewetting. This felt comprises a base layer, a wet paper web side batt layer, and press side batt layer, with a hydrophilic nonwoven fabric being disposed within the wet paper web side batt layer. According to this invention, the hydrophilic nonwoven fabric absorbs and retains water within the wet paper web side batt layer, thereby effectively preventing rewetting.

Moreover, it is also essential for a press felt to have a capability of recovering to its uncompressed state after compression without being flattened (resistance to compression fatigue), a capability of improving smoothness of the wet paper web by smoothness of the felt itself (smoothness), and dehairing and abrasion resistance.

Unexamined Japanese Patent Publication No. 302584/1996, for example, discloses a felt with such capabilities which includes fibers with a core-in-sheath structure made from a two-component material.

According to this invention, the two-component material used for a fiber to form a batt layer is composed of a sheath member with a low melting point and a core member with a high melting point. With heat hardening processing of the press felt, the sheath member with a low melting point gets softened to form a matrix within the batt layer, which enhances dewatering capability and compression resistance of the press felt.

Further, press felts made of a woven fabric with improved dewatering capability and smoothness are employed in recent high-speed paper manufacturing machines. The fabric is woven with a warp yarn (CMD yarn) and a weft yarn (MD yarn), both of which are monofilament single yarns (Unexamined Japanese Patent Publication No. 170086/2000).

Here, "machine direction (MD)" refers to the longitudinal direction in which a press felt is transferred in a paper manufacturing machine, whereas "cross machine direction (CMD)" refers to the lateral direction which crosses the machine direction.

DISCLOSE OF INVENTION

However, the press felts disclosed in the first two publications tend to be vulnerable to compression.

In addition, the press felt with the batt layer made from the two-component material, as disclosed in the second publication, No. 302584/1996, tends to require short-term replacement due to cutoffs of fibers, dehairing or abrasion during use, because thermal pressurization in the manufacturing process causes deterioration of mechanical strength or chemical degradation.

On the other hand, the press felt disclosed in the third publication No. 170086/2000 is known to be much inferior to conventional felts using twisted yarns in terms of dehairing and abrasion resistance, because the batt fibers and the woven fabric are not firmly integrated by needle punching.

Thus, there is a need for a press felt not only with anti-rewetting capability but with a balanced combination of advantages, such as, resistance to compression, smoothness, and dehairing and abrasion resistance.

In view of the above problems, the object of the present invention is to provide a press felt for paper manufacture being capable of preventing rewetting and having superior smoothness and resistance to abrasion and compression fatigue.

The present invention solved the above-mentioned problems with a press felt comprising a base body and a batt layer including a wet paper web side layer, characterized in that said wet paper web side layer comprises at least a base body side batt layer, and said base body side batt layer includes an upright fiber bundle formed therein.

Said upright fiber bundle is formed after needle punching of a core-in-sheath composite fiber and/or a meltable fiber, by the fusion of the sheath member of said core-in-sheath composite fiber or a partly fused meltable fiber in the form of a pillar by heat treatment, or intertwined fibers caused by needle punching of a fibrillatable fiber.

Here, the "upright fiber" refers to the fiber (staple fiber) within the batt layer, the axial direction of which is oriented from the side of the base body of the felt toward the side of the wet paper web contact surface. And, the "upright fiber bundle" refers to a bundle of fibers composed at least of 3 such upright fibers.

Such a structure can be confirmed by a microscope.

The base body side batt layer contains at least one of, a core-in-sheath composite fiber, a meltable fiber or a fibrillatable fiber. A core-in-sheath composite fiber and a meltable fiber are fibers which contain a nylon component of a low melting point that may be caused to fuse by heat treatment in a manufacturing process of a press felt.

And the content of said core-in-sheath fiber, meltable fiber or fibrillatable fiber within said base body side batt layer is preferably in the range of 10-100%.

Further, said base body is preferably a fabric woven with a CMD yarn and an MD yarn, both of which are monofilament single yarns.

ADVANTAGES OF INVENTION

According to the present invention, the base body side batt layer is made dense due to melting of the sheath member of the core-in-sheath fiber or a part of the meltable fiber. As a result, said base body side batt layer works as a barrier to block water within the press side layer from moving to the wet paper web side, thereby preventing rewetting.

Moreover, the invention successfully enhances resistance to dehairing, abrasion, and compression fatigue of the press felt by providing the core member of the core-in-sheath fiber with high viscosity, i.e. by using high-molecular-weight nylon. As a result, the press felt of the present invention can be made more durable, reducing the need for replacement, contributes to improve the quality of the finished paper with fewer fibers attached thereon due to dehairing and abrasion, and is capable of maintaining smoothness of the paper contact surface.

Also, a bundle of upright fibers is generated in the direction of the base body side from a wet paper web contact surface of the felt as the fibrous layer including the core-in-sheath composite fiber and/or the meltable fiber is integrated in advance by means of pre needle punching; and the sides of fiber of the core-in-sheath composite fiber and/or the meltable fiber are caused to adhere to one another through heat adhesion by heat treatment during the manufacturing process of the press felt, bringing about the fusion of the sheath member of the core-in-sheath composite fiber and/or a part of the meltable fiber forming a fusion-bonded upright fiber bundle within the base body side batt layer, so that the compression fatigue resistance characteristics and the abrasion resistance characteristics of the felt can be improved.

Here, the "pre needle punching", refers to the needle punching done on only the base body side batt layer which includes the core-in-sheath composite fiber and/or the meltable fiber, or the fibrillatable fiber, before it is intertwiningly integrated with the base body or the press side batt layer by needle punching.

Further, in case the fibrous layer including the fibrillatable fiber is integrated by means of pre needle punching so as to form the upright fiber bundle, the fibrillatable fibers composing the upright fiber bundle becomes intertwined with one another due to the ease of causing intertwining of the fibers attributable to the fibrous structure itself of the fibrillatable fiber; and without the later heat treatment, the structure of the upright fiber bundle becomes such that unraveling is no longer possible. Thus, the present invention successfully enhances resistance to abrasion and compression fatigue of the press felt.

Furthermore, the present invention improves dewatering capability as well as resistance to dehairing and abrasion of the press felt by using a fabric woven with monofilament single yarns for the base body and thus enhances water permeability thereof.

PREFERRED EMBODIMENTS OF THE INVENTION

The first embodiment of a press felt of this invention is to be detailed hereafter.

Figure 1:
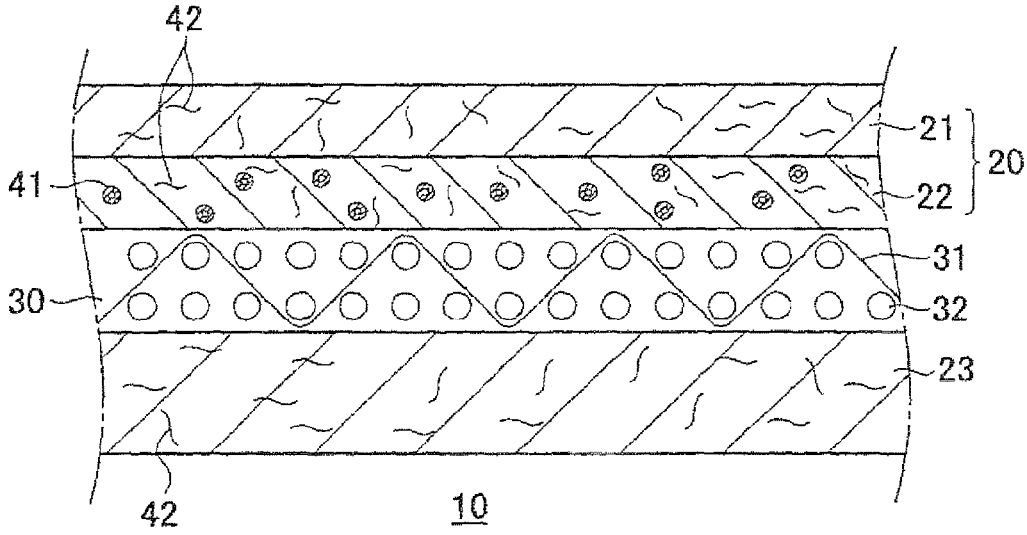
FIG. 1 is a CDM directional sectional view of the first embodiment of a press felt of the present invention.

FIG. 1 is a CMD directional sectional view of a press felt 10 of the present invention in the first embodiment of the present invention/a core-in-sheath composite type fiber was used as the fiber included in the base body side batt layer, In this connection, the "core-in-sheath composite fiber" refers to the fiber which has a core member made of high-molecular-weight nylon and a sheath member of nylon with a lower melting point than the core member.

As shown in FIG. 1, the press felt 10 comprises a base body 30, a wet paper side batt layer 20, and a press side batt layer 23, the wet paper web side batt layer 20 having a wet paper web contact side batt layer 21 and a base body side batt layer 22 which is formed inside of the wet paper web contact side batt layer 21.

The wet paper web contact side batt layer 21, the base body side batt layer 22, and the press side batt layer 23 are made of staple fibers, with the base body side batt layer 22 and the press side batt layer 23 intertwiningly integrated by needle punching with the wet paper web side and the press side of the base body 30 respectively. The wet paper web contact side batt layer 21 is intertwiningly integrated with the base body side batt layer 22.

The base body side batt layer 22 is a fibrous layer including a core-in-sheath composite fiber, and preferably is integrated in advance by pre needle punching before it is disposed on the base body 30 on the side of the wet paper web, but it is also possible without the pre needle punching to have the base body side batt layer 22 including the core-in-sheath composite fiber directly disposed on the base body 30 inside the wet paper web side batt layer 21 and intertwiningly integrated to obtain the wet paper web side batt layer 20 by needle punching.

Preferable nylon used for the core member includes high-molecular-weight nylon 6, high-molecular-weight nylon 66, high-molecular-weight nylon 610, and high-molecular-weight nylon 612. More specifically, nylon obtained by way of polycondensation of nylon salt is preferable, such as polymerization of ϵ caprolactam (nylon 6), polycondensation of hexamethylenediamine adipate (nylon 66), polycondensation of 1,4-diamino-butane adipate (nylon 46), polycondensation of hexamethylenediamine sebacate (nylon 610), polycondensation of hexamethylenediamine dodecanedioic diacid (nylon 612), and aliphatic nylon can also be included which has a melting point of 200 degrees Celsius or more measured by DSC (Differential Scanning Calorimetry).

Nylon used for the sheath member of the core-in-sheath fiber 41 should have a lower melting point than the core member. Preferred nylon includes nylon 6/12, nylon 6/610, nylon 66/6, nylon 66/12, binary copolymerized nylon such as nylon 66/610, ternary copolymerized nylon such as nylon 6/66/12 and nylon 6/66/610. As is known in the art, a melting point of these copolymerized nylon fluctuates depending on their composition (or weight percentages of copolymerized elements), and only those with a melting point of 180 degrees Celsius or less is usable for the present invention.

According to the present invention, preferably, the core-in-sheath composite fiber 41 is not included in the wet paper web contact side batt layer 21, which may be composed of an ordinary nylon fiber 42 and such a constitution that the core-in-sheath composite fiber 41 is included in only the base body side batt layer was selected as the first embodiment. However, such constitutions as having only the base body side batt layer without the wet paper web contact side batt layer 21, or having no press side batt layer, or without having neither the wet paper web contact side batt layer nor the press side batt layer, are possible.

The core-in-sheath layer 22 is preferably made of a blend of the core-in-sheath fiber 41 and an ordinary nylon fiber 42 to achieve a better balance of smoothness, abrasion and compression resistance. Preferably, the blend consists of 10-100% of the core-in-sheath composite fiber 41 and 90-0% of the nylon fiber 42.

When the content of the core-in-sheath composite fiber 41 is less than 10%, formation of the fusion-bonded bundle of upright fiber decreases; and consequently, compression fatigue resistance characteristics as well as abrasion resistance characteristics will deteriorate.

The frequency of pre needle punching of the fibrous layer including the core-in-sheath composite fiber was 30 times or more (needling frequency per unit area $cm^2$).

The ratio of the volume of the core and the sheath members of the core-in-sheath composite fiber 41 can range from 5:1 to 1:5, but is preferably 1:1.

The nylon fiber 42 used for the wet paper web contact side batt layer 21, the press side batt layer 23, and for the blend with the core-in-sheath fiber 41 is preferably nylon 6, nylon 66, nylon 46, nylon 610, and nylon 612 etc.

Preferably, the base body 30 is a fabric woven with a CMD yarn 31 and an MD yarn 32 which are monofilament single yarns. It can be a double cloth such as [2/1, 1/2], [3/1, 1/3], and [5/1, 1/5], a triple cloth, or multilayered texture such as [a single cloth+a double cloth], [a double cloth+a double cloth]. The monofilament single yarn may be one with a diameter of 0.1 mm-0.6 mm and a yarn density of 10-100 yarns/25 mm.

However, the base body 30 need not be a woven fabric, and other structures and methods can be employed as appropriate, such as, simply overlapping an MD yarn and a CMD yarn, a film, a knitted fabric, or winding a narrow belt-shaped body to make a belt-shaped body of relatively large width. Further, appropriate materials for the base body 30 include natural fibers such as wool, and synthetic fibers such as polyester, nylon 6, and nylon 66 which have superior abrasion and fatigue resistance, distensibility, and antifouling properties.

Preferable fineness of the core-in-sheath fiber 41 is 15-25 dtex fora pick-up felt used in the first stage in a press part of a paper manufacture machine, and 10-20 dtex for a felt in second and third presses used in the middle of the press part thereof.

Also, for the fourth press in the last stage of the press part and a shoe press, 5-20 dtex is preferred.

Preferred fineness of the nylon fiber 42 is 10-25 dtex and 15-25 dtex for the paper side batt layer 20 and the press side batt layer 23 respectively of the pick-up felt used in the first stage of the press part.

Further, for the wet paper web side layer 20 used in the second and third presses in the middle of the press part thereof, 10-15 dtex is preferable; and for the press side batt layer 23, 10-20 dtex fineness is suitable.

Finally, for the wet paper web side batt layer 32 used in the fourth press in the last stage of the press part or for a shoe press, 5-15 dtex is suitable; and 5-20 dtex for the press side batt layer 23 is preferable.

It is to be noted that as the first embodiment of the present invention, a core-in-sheath composite fiber wherein by heat treatment the sheath member melts but the core member does not was employed as the fiber included in the base body side batt layer 22, but instead of the core-in-sheath composite fiber, a meltable fiber may be used, or a core-in-sheath composite fiber and a meltable fiber may be used at the same time.

Here, the "meltable fiber" refers to the fiber, all the components of which are made with low melting point materials, and thus totally meltable at comparatively low temperatures. When the base body side batt layer contains a fiber including the meltable fiber, with the operation of heat press at the time of felt production somewhat relaxed compared with the case involving the core-in-sheath composite fiber, only the sides of the meltable fiber can be melted, so that the fusion-bonding of the bundle of upright fiber in the shape of a pillar can be achieved.

Furthermore, as the fiber included in the base body side batt layer 22, a fibrillatable fiber may be used in place of the core-in-sheath composite fiber and/or the meltable fiber.

Here, the "fibrillatable fiber" refers, for example, to the fiber comprising six fan-shaped petal sections and one stem section which is approximately asterisk-shaped and interposing between the adjacent petal sections, the total seven sections being united in a circular section and in a separable or dividable manner. The petal sections are, for example, formed with nylon 6 (in other words, N6) and the stem section is formed, for example, with polybuthylene terephthalate (in other words, PBT). As an operative example of such a fibrillatable fiber, brand name "PA31: by Toray Industries, Inc.", etc., is available.

This fibrillatable fiber does not melt by heat press in a manufacturing process, but an upright fiber bundle can be formed by pre needle punching, and the fibers composing the upright fiber bundle are securely entwined with one another. In other words, as the section of each fiber is not a round shape, but irregularly shaped, such as, an asterisk or triangle, entwining each other takes place rather easily, thereby forming an upright fiber bundle by means of pre needle punching, which is resistant to unraveling even without heat treatment.

EXAMPLES

The press felt of the present invention is to be described using following examples. However, it should be noted that the present invention is not limited to these examples.

(Core-in-Sheath Composite Fiber)

In the examples, nylon 6 (melting point: 220 degrees Celsius was used as the core member and copolymerized nylon 6/12 (melting point: 140 degrees Celsius) was used as the sheath member to produce a core-in-sheath staple fiber in which a volume ratio of the core and sheath members is 1:1. Concretely, "BA 140" marketed by EMS Company was used.

(Production of Press Felt for Paper Manufacture)

For comparison, examples and comparative examples are all provided with a common basic structure as follows;

Base body: Woven fabric A [a double cloth of (3/1, 1/3) using plied yarns made of two nylon monofilaments of 240 dtex for an MD direction yarn and a CMD direction yarn], basis weight: 300 $g/m^2$ Woven fabric B [a double cloth of (3/1, 1/3) using single yarns of 1100 dtex nylon monofilament for an MD direction yarn and a CMD direction yarn], total basis weight: 300 $g/m^2$ Batt Layers:

Staple fibers of 6 dtex nylon 6 for the wet paper web contact side batt layer, total basis weight: 120 $g/m^2$ Staple fibers of 17 dtex composite fiber for the base body side batt layer (core-in-sheath composite fiber layer), total basis weight: 120 $g/m^2$ Staple fibers of 17 dtex nylon 6 for the press side batt layer, total basis weight: 100 $g/m^2$ At first, batt raw materials (staple fiber of composite fiber of 17 dtex and blend of staple fiber of nylon 6 of 17 dtex) were prepared for step 1.

Disentangling the batt raw materials shown in Table 1 with a carding machine located preceding a needling machine, a layered web was provided. This was punched with a needling machine (the pre needle punching frequency shown in the following Table 1.) and the base body side batt layer by pre needle punching of total basis weight 120 g/m$^2$ was formed.

In the next place, for step 2, the base body (woven fabric) was set on a needling machine, and the base body side batt layer formed with the pre needle punching was put on the wet paper web side of the base body, and needle punching (100 times) was conducted for the second time, and the base body side batt layer was integrated with the base body.

Next, a web of wet paper web contact side batt fiber was supplied by a carding machine on the wet paper web side of the base body side batt layer, and needle punching (150 times) was performed and the wet paper web contact side batt layer was obtained.

The base body was next turned over, and a web of the press side batt fiber was supplied by a carding machine on the press side by needle punching (150 times), and the press side batt layer was formed.

Figure 2:
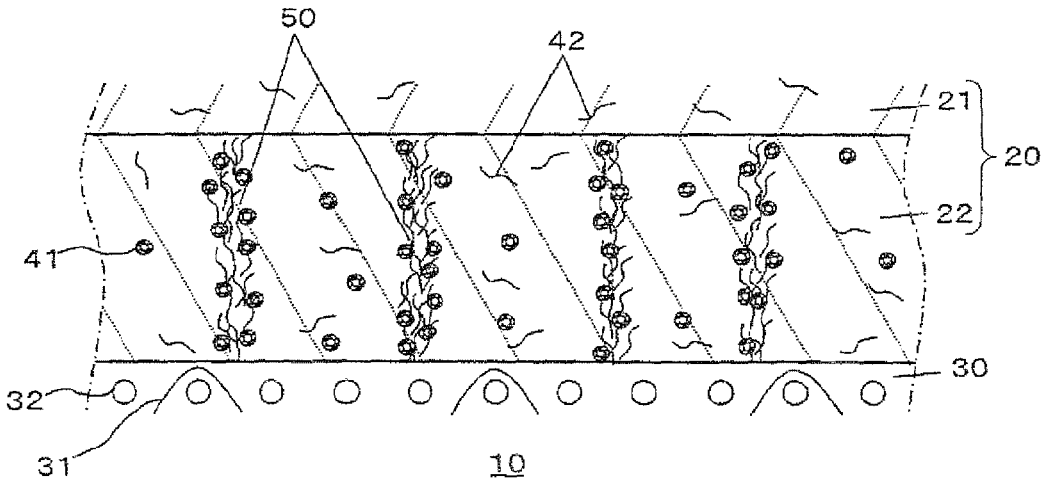
FIG. 2 is an enlarged CMD directional sectional view of a of the first embodiment of a press felt of the present invention.

FIG. 2 is an enlarged sectional view of CMD of an embodiment of a press felt of the present invention (press side batt layer 23 is omitted for convenience.) By the step 2, the upright fiber bundles 50 as shown in FIG. 2 are formed.

Finally, for step 3, the felt after the needle punching was moved back and forth at the rate of 2 m/min within a pair of heat calender rolls (roll temperature 160 degrees Celsius, line pressure 50 kg/cm) five times, and the sheath member in the core-in-sheath composite fiber of the base body side batt layer was fusion-bonded, and a felt of the present invention was obtained.

Figure 3:
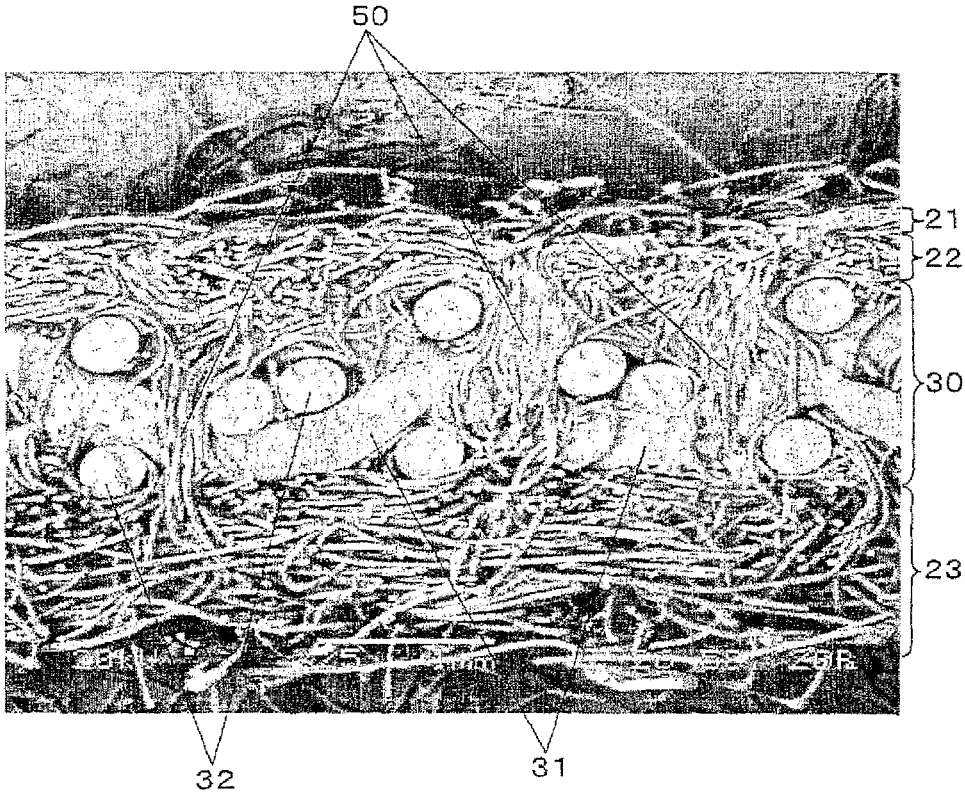
FIG. 3 is a sectional electron microscope photograph from the wet paper web side of the base body side batt layer to the press side of an example of a press felt of the present invention.
Figure 4:
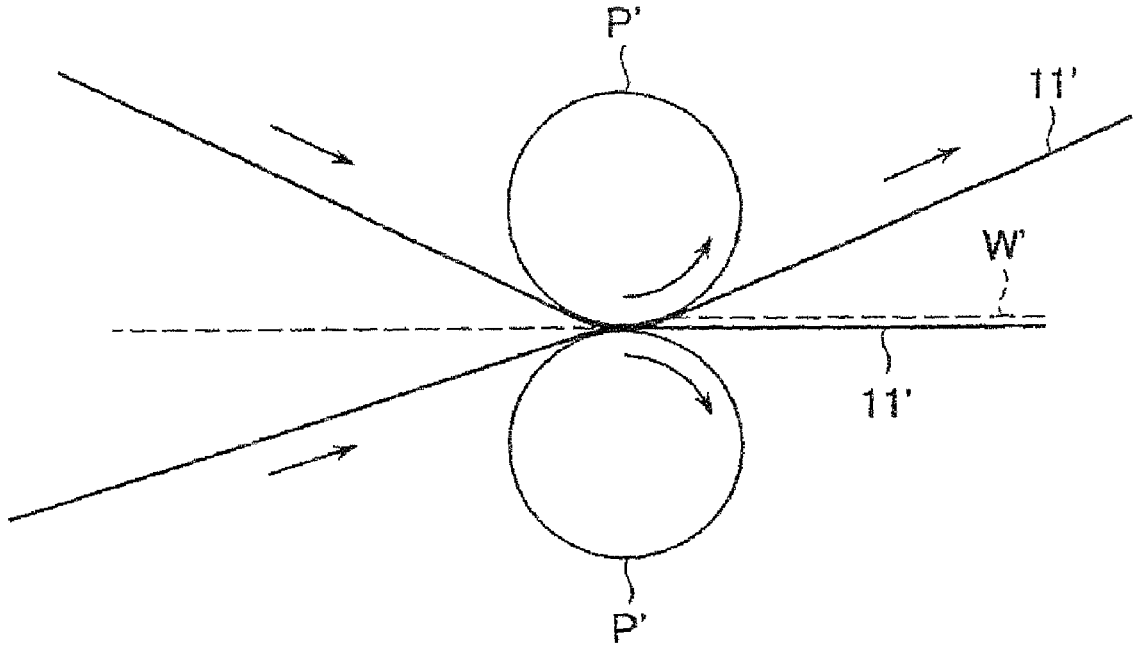
FIG. 4 is a schematic view of a press apparatus of a paper manufacturing machine.

FIG. 3 is a sectional electron microscope photograph from the wet paper web side of the base body side batt layer of an example of the present invention to the press side, and it was confirmed that upright fiber bundles were in fact fusion-bonded in the shape of a pillar.

In FIG. 2, the upright fiber bundles 50 were formed only in the base body side batt layer 22, but, in step 1, pre needle punching the base body side batt layer 22 and if in step 2, the press side batt layer 23, the base body side batt layer 22 and the base body 30 are needle punched together, the upright fiber bundle 50 formed by needle punching of step 2 may penetrate through the base body side batt layer 22, and may naturally extend to the base body 30, and even to the press side batt layer 23.

In FIG. 3, the upright fiber bundle 50 penetrates through the base body side batt layer 22, the base body 30 and to the press side batt layer 23.

The compositions of Examples 1-12 and Comparative Examples 1-2 are shown in Table 1 respectively.

TABLE 1

| | Examples | | | | | | | | | | | | Comparative Examples | |
|---|---|---|---|---|---|---|---|---|---|---|---|---|---|---|
| | 1 | 2 | 3 | 4 | 5 | 6 | 7 | 8 | 9 | 10 | 11 | 12 | 1 | 2 |
| wet paper web contact side batt layer | nylon | nylon | nylon | nylon | nylon | nylon | nylon | none | nylon | none | nylon | nylon | nylon | nylon |
| base body side batt layer (percentage of blending core-in-sheath fiber; weight %) | 50 | 50 | 50 | 50 | 50 | 75 | 100 | 75 | 75 | 75 | 50 | 50 | 0 | 0 |
| pre needle punching frequency (times per cm$^2$) | 3 | 30 | 50 | 100 | 200 | 200 | 200 | 200 | 200 | 200 | 100 | 200 | 100 | 200 |
| base body | woven fabric A | woven fabric A | woven fabric A | woven fabric A | woven fabric A | woven fabric A | woven fabric A | woven fabric A | woven fabric A | woven fabric A | woven fabric B | woven fabric B | woven fabric A | woven fabric A |
| press side batt layer | nylon | nylon | nylon | nylon | nylon | nylon | nylon | nylon | none | none | nylon | nylon | nylon | nylon |

notes:
nylon = nylon 6

Tests were conducted with following conditions and methods to evaluate resistance to compression fatigue, dehairing and abrasion resistance, using Examples and Comparative Examples listed above.

(Compression Fatigue Resistance Test)

Felts are subjected to 200,000 times of 10 Hz pulse load at 150 kg/cm$^2$. Resistance to compression fatigue is evaluated based on a ratio of density after tests to that of a finished felts where the ratio of less than 1.4 is evaluated as "excellent", 1.40-1.49 as "good", and over 1.50 as "poor".

(Dehairing and Abrasion Resistance Test)

Dehairing and abrasion resistance of the felts was determined by means of a Taber abrasion tester based on JIS1023-1992. The amount of fibers dropped was measured by placing a discoidal sample piece on a rotating turntable and applying a rotating roll with intense resistance on the sample piece (load: 1 kg, wheel: CS-17, rotation: 5000 times, unit of measurement: mg).

The amount of less than 50 mg is evaluated as "excellent" with 50 mg-99 mg evaluated as good and over 100 g evaluated as "poor".

Results of measurement and evaluation are shown in Table 2. A value of "the number of fusion-bonded upright fiber bundles" of Table 2 counts the number of fusion-bonded upright fibers taken by a micrograph photography in the machine direction section and the cross machine direction section respectively and it was expressed in the product thereof.

TABLE 2

| | compression fatigue resistance test | Tabor abrasion resistance test (mg) | number of fusion-bonded upright fiber bundle |
|---|---|---|---|
| Example 1 | 1.51 (poor) | 80 (good) | indistinct |
| Example 2 | 1.49 (good) | 75 (good) | 10 per $cm^2$ or less |
| Example 3 | 1.46 (good) | 65 (good) | 30 per $cm^2$ or less |
| Example 4 | 1.42 (good) | 55 (good) | 100 per $cm^2$ or less |
| Example 5 | 1.38 (excellent) | 50 (good) | 100 per $cm^2$ or more |
| Example 6 | 1.35 (excellent) | 45 (excellent) | 100 per $cm^2$ or more |
| Example 7 | 1.32 (excellent) | 40 (excellent) | 100 per $cm^2$ or more |
| Example 8 | 1.38 (excellent) | 55 (good) | 100 per $cm^2$ or more |
| Example 9 | 1.38 (excellent) | 45 (excellent) | 100 per $cm^2$ or more |
| Example 10 | 1.42 (good) | 60 (good) | 100 per $cm^2$ or more |
| Example 11 | 1.36 (excellent) | 50 (good) | 100 per $cm^2$ or more |
| Example 12 | 1.34 (excellent) | 45 (excellent) | 100 per $cm^2$ or more |
| Comparative Example 1 | 1.55 (poor) | 100 (poor) | none |
| Comparative Example 2 | 1.57 (poor) | 95 (good) | none |

As indicated by the test results of Examples 2-7 in Table 2, it was determined that the press felt of the present invention achieves a balanced combination of resistance to compression fatigue, dehairing and abrasion resistance, and smoothness. Also, as shown in the Example 8 or 9, a similar result was provided without the wet paper web contact side batt layer or an embodiment without the press side batt layer. Even more particularly, the press felt in Example 10 with neither of the wet paper web contact side batt layer or the press side batt layer, a certain degree of combined abrasion resistance characteristics and compression fatigue resistance characteristics has been attained.

In addition, with the Examples 11 and 12, in which a woven fabric B woven with single yarns of a monofilament was employed as the base body, the abrasion resistance characteristics and compression fatigue resistance characteristics have improved still more compared with the Examples 4 and 5, in which a woven fabric A woven with spinning yarns of a monofilament as the base body was used. In other words, for the press felt for paper manufacture of the present invention, a result that contribution of the fabric is high in terms of the abrasion resistance and compression fatigue resistance has been obtained.

In contrast, the compression fatigue resistance characteristics were found to be poor in the case of the Example 1, with less than 30 times of pre needle punching, and in the case of the Comparative Example 2 in which the core-in-sheath composite fiber was not included but the pre needle punching was provided 200 times; and in case of the Comparative Example 2, which also does not include the core-in-sheath composite fiber and the pre needle punching was done only 100 times, compression fatigue resistance as well as the abrasion resistance characteristics were poor at the same time.

The foregoing results show that, abrasion resistance characteristics as well as compression fatigue resistance characteristics of a felt improve as the content of the core-in-sheath composite fiber and the number of times of the pre needle punching increase, because the number of the fusion-bonded upright fiber bundles increase thereby.

INDUSTRIAL APPLICABILITY

According to the present invention, the base body side batt layer is made dense due to melting of the sheath portion of the core-in-sheath fiber or a part of the meltable fibers. As a result, said base body side batt layer works as a barrier to block water within the press side layer from moving to the paper side, thereby preventing rewetting.

Moreover, the invention successfully enhances resistance to dehairing, abrasion, and compression fatigue of the press felt by providing the core member of the core-in-sheath fiber with high viscosity, i.e. by using high-molecular-weight nylon. As a result, the press felt of this invention is made more durable, reducing the need for replacement, contributes to improve the quality of the finished paper with fewer fibers attached thereon due to dehairing and abrasion, and is capable of maintaining smoothness of the paper contact surface.

In addition, there are generated bundles of upright fiber in the direction from the base body side to the wet paper web contact surface of the felt, as the fiber layer including the core-in-sheath composite fiber and/or the meltable fiber is integrated by means of the pre needle punching in advance; and, in this upright fiber bundles, the sheath member and/or a part of the meltable fiber are fused by the heat press operation of a manufacturing process of a press felt thereby forming the fusion-bonded bundles of the upright fiber in the of base body side batt layer, which contributes to improvement of the compression fatigue resistance characteristics and the abrasion resistance characteristics of the felt.

Also, with pre needle punching of the fiber layer including the fibrillatable fiber in advance so as to integrate it to form the upright fiber bundle, the fibers composing the upright fiber bundle are made to be intertwined with one another due to the structural ease of entwining of the fiber and, even without heat treatment, they can form bundles of upright fibers that are resistant to unraveling, which contributes to the improvement in abrasion resistance as well as compression fatigue resistance.

Finally, the present invention improves dewatering capability as well as resistance to dehairing and abrasion of the press felt by using a fabric woven with single yarns of monofilaments for the base body and thus enhancing water permeability thereof.

What is claimed is:

1. A press felt for paper manufacture comprising a base body and a batt, the batt including a wet paper web side batt layer and a base body side batt layer, said base body side batt layer including upright fiber bundles formed therein, wherein each said upright fiber bundle comprises fibers from the group consisting of core-in-sheath composite fibers having a meltable sheath, and meltable fibers, the fibers of each said upright bundle being heat-fused to one another by heat treatment after needle punching, each of said upright bundles being in the shape of a pillar.

2. A press felt for paper manufacture according to claim 1, wherein the fibers of said group consisting of core-in-sheath composite fibers having a meltable sheath and meltable fibers constitute from 10% to 100% of said base body side batt layer.

3. A press felt for paper manufacture according to claim 1 in which the fibers of each said upright bundle include core-in-sheath fibers having a meltable sheath, the sheaths of said core-in sheath fibers being fused to one another.

4. A press felt for paper manufacture according to claim 1 in which the fibers of each said upright bundle include meltable fibers, said meltable fibers being partly melted and fused to one another.

5. A press felt for paper manufacture according to claim 1, wherein said base body is a fabric woven of MD direction yarns and CMD direction yarns, said yarns being single yarns of monofilament.

6. A press felt for paper manufacture according to claim 1, in which said wet paper web contact side batt layer comprising a nylon layer substantially free of core-in-sheath composite fibers, meltable fibers and fibrillateable fibers.

7. A press felt for paper manufacture according to claim 1, further comprising a batt layer including a press side layer.

8. A press felt for paper manufacture comprising a base body and a batt, the batt including a wet paper web side batt layer and a base body side batt layer, said base body side batt layer including upright fiber bundles formed therein, wherein each said upright fiber bundle is formed by fibers intertwined with one another by needle punching of fibrillatable fibers.

9. A press felt for paper manufacture according to claim 8, wherein said fibrillatable fibers constitute from 10 to 100% of said base body side batt layer.

10. A press felt for paper manufacture according to claim 8, wherein said base body is a fabric woven of MD direction yarns and CMD direction yarns, said yarns being single yarns of monofilament.

11. A press felt for paper manufacture according to claim 8, in which said wet paper web contact side batt layer comprising a nylon layer substantially free of core-in-sheath composite fibers, meltable fibers and fibrillateable fibers.

12. A press felt for paper manufacture according to claim 8, further comprising a batt layer including a press side layer.

* * * * *